US005215025A

United States Patent [19]

Talmor

[11] Patent Number: 5,215,025

[45] Date of Patent: Jun. 1, 1993

[54] BOAT

[75] Inventor: Amnon Talmor, Ann Arbor, Mich.

[73] Assignee: K10 Corporation, Ann Arbor, Mich.

[21] Appl. No.: 550,374

[22] Filed: Jul. 10, 1990

[51] Int. Cl.[5] ..... B63B 1/00

[52] U.S. Cl. ..... 114/56; 114/125

[58] Field of Search ..... 114/56, 57, 125, 74 A

[56] References Cited

U.S. PATENT DOCUMENTS

| | | | |
|---|---|---|---|
| 850,034 | 4/1907 | Miller | 114/57 |
| 860,492 | 7/1907 | Mehrtens | 114/125 |
| 970,368 | 9/1910 | Frahm | 114/125 |
| 2,077,143 | 4/1937 | Carroll | 114/125 |
| 3,109,294 | 11/1963 | Messer | 114/74 A |
| 3,213,632 | 10/1965 | Volk et al. | 114/74 A |
| 3,363,598 | 1/1968 | Mortrude | 114/56 |
| 3,503,358 | 3/1970 | Moesly | 114/125 |

*Primary Examiner*—Jesus D. Sotelo

*Attorney, Agent, or Firm*—Harness, Dickey & Pierce

[57] ABSTRACT

The invention provides for a versatile boat which is highly stable and maneuverable in a variety of water conditions. The boat is substantially symmetrical about a longitudinal, vertical plane and has a lower hull portion that is generally V-shaped in cross section. Connected to the lower hull portion is a generally inverted V-shaped upper hull portion which is interrupted in both the bow and stern by decks inclined toward the longitudinal plane. Positioned interiorly of the hull sections and extending substantially the length of the boat is an internal barge structure. The barge structure is spaced apart from the hull sections to define ballast compartments in between these structures. When flooded, the ballast compartments enable the boat to operate in a semi-submerged position while floating on the internal barge structure. The boat is further provided with a separate bow ballast tank which, when flooded, shifts the boat's center of gravity to further increase its stability and reduce vertical acceleration through oncoming waves.

14 Claims, 4 Drawing Sheets

BOAT

The present invention relates in general to boats and more particularly a boat designed for increased stability and maneuverability under a variety of weather conditions.

As the popularity of boating has increased, so has the number and variety of boats that are available. One constant which all boat designers strive for is stability, and more precisely, stability under a variety of operating, weather and water conditions. This is especially true of boats designed for high speed operation or for use in large bodies of water. Such bodies of water can be particularly dangerous when affected by adverse weather, such as sudden storms and high winds, resulting in waves and swells of a magnitude not seen on lesser bodies of water. Thus, when designing a boat for use on large bodies of water, its stability during high sea-stages becomes a particular concern. To so design a boat without sacrificing the boat's maneuverability is of an increased desirability.

It is therefore an object of the present invention to provide a boat which remains stable in a wide range of possible weather and sea conditions.

It is an additional object of the present invention to provide a boat which maintains a high degree of stability without sacrificing its maneuverability.

The boat of the present invention incorporates a variety of features designed to increase its stability during high sea-stages. One feature of the present invention is that the boat is provided with an internal barge structure. Cooperating with the exterior hull or skin of the boat, the barge structure defines a plurality of ballast compartments which, when flooded, cause the boat to float partially submerged in the water. When flooded, the boat floats on the internal barge itself and is less susceptible to the influences of wind and waves.

The internal barge structure extends longitudinally within the boat and defines a bow ballast compartment, a port ballast compartment, a starboard ballast compartment and a lower ballast compartment. By flooding the bow ballast compartment the center of gravity in the boat may be shifted to reduce vertical acceleration in waves. A means for evacuating water from the flooded ballast compartments is also provided to permit the boat to resume operation in a more traditional position, floating on the exterior hull.

Another feature of the present invention is the inclination of the boat's upper surfaces. Those surfaces above the chine generally incline toward a vertical plane through the longitudinal center of the boat. However, no surface exhibits an incline exceeding forty-five degrees (45°), as measured up from a horizontal plane. With all of the above water surfaces inwardly inclined, the boat displays a tendency to ride through waves and swells without undue rolling or pitching being induced by the impact of the swell upon the boat itself. This is not to be interpreted as saying the boat will not exhibit any rolling or pitching effects. Some minor rolling is to be expected in all boats given the appropriate sea conditions.

A third feature which also increases the stability of the present invention is the unique shape of the boat's bow. The bow has a shape which eliminates the presence of water on the upper deck and thus, the downward pressure normally exhibited by such water. If water does reach the bow deck, the surface of the deck and the wedge-like cockpit will evacuate it to the sides of the boat.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 1:
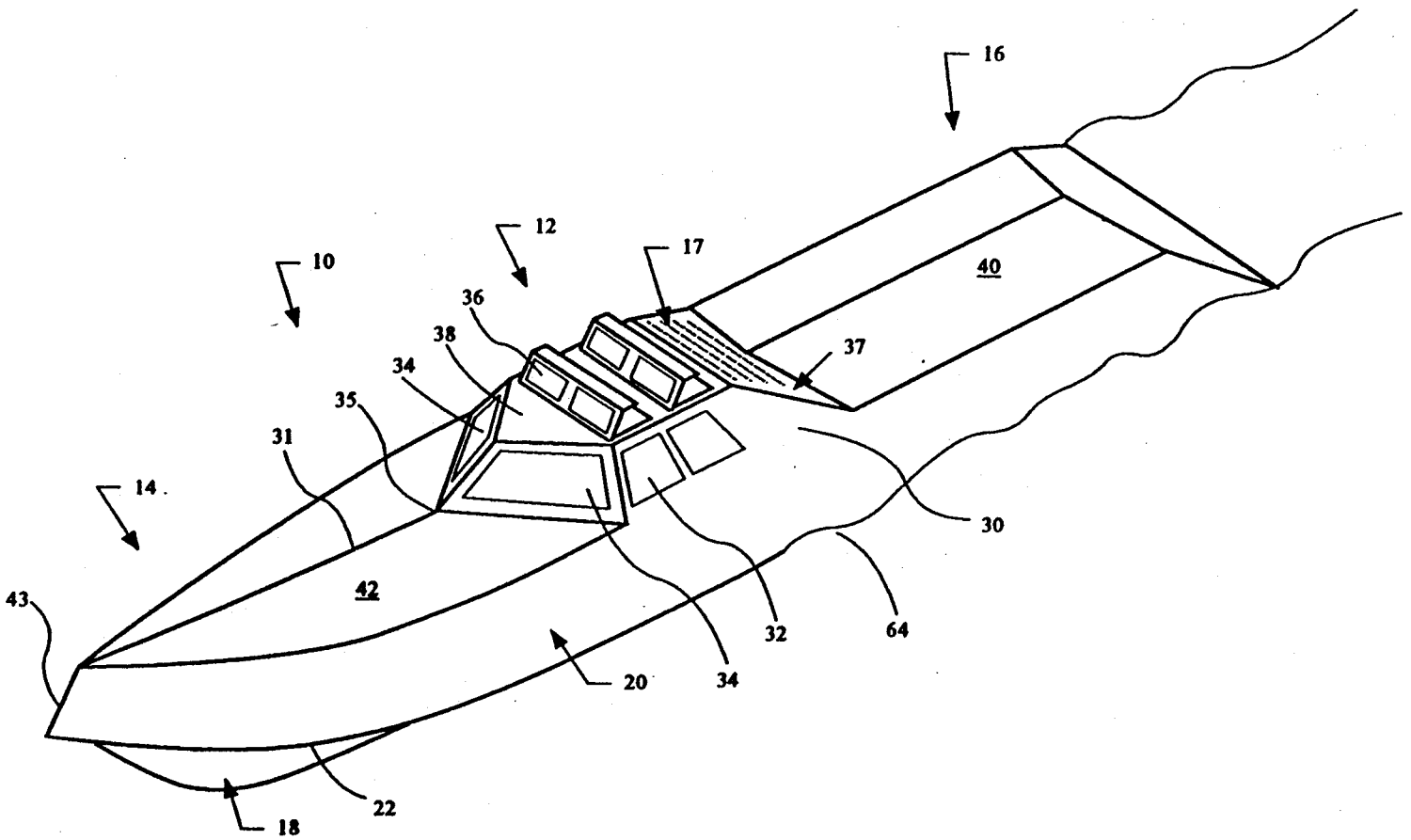
FIG. 1 is a perspective view of a boat incorporating the principles of the present invention and operating in a planing mode.

Now with reference to the drawing, a boat embodying the principles of the present invention is illustrated in FIG. 1 and generally designated as 10. As is typical of boats, it includes a cockpit 12 which divides the boat into a bow region 14 and a stern region 16.

Figure 5:
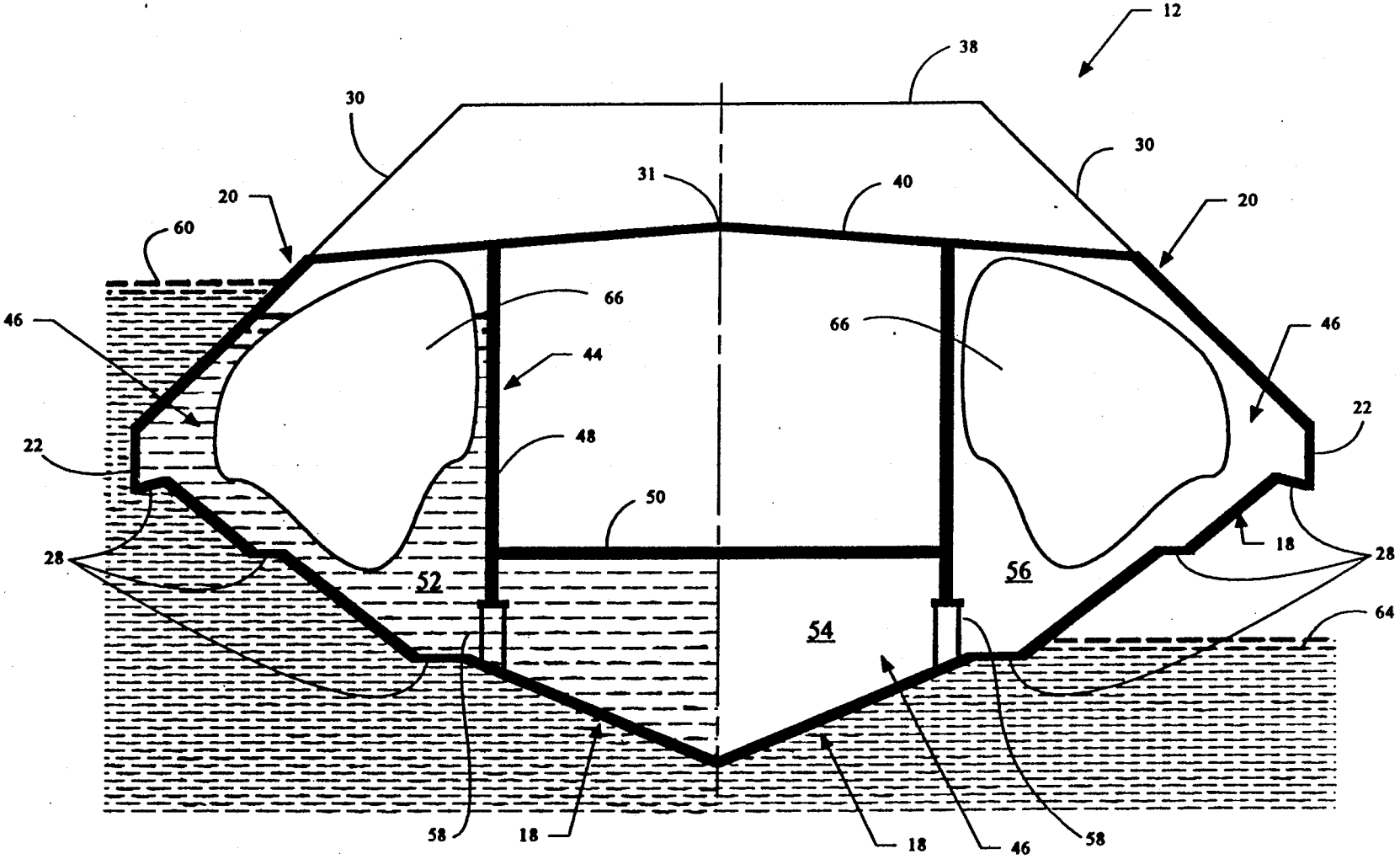
FIG. 5 is a sectional view of the present invention taken substantially along line 5—5 in FIG. 3 illustrating the internal barge and ballast compartments, along with the position of the boat relative to the water line, both prior to flooding with water and subsequently thereafter.

While the boat 10 is fully operational through speeds of 40 knots and greater, the boat 10 will be generally described as having two operational modes. The first mode will be termed the planing or fully bouyant operational mode (right half of FIG. 5) and the second mode will termed the semi-submerged or low operational mode (left half of FIG. 5). When in the planing mode, the boat's ballast compartments 46 (further described below) are empty. In this mode, the boat rides "high" in the water and is capable of being on plane (see FIG. 1). When in the low operational mode, the boat's ballast compartments 46 are flooded and the boat partially submerged. The boat 10 is operable in this mode to speeds of approximately 10 knots (see FIG. 2) and is extremely stable in a wide variety of sea conditions.

The cockpit 12 may be located anywhere along the boat 10. In a preferred embodiment, the cockpit 12 is located near the midsection, slightly forward of the point representing the longitudinal center of the boat 10. Such positioning of the cockpit 12 provides the operator with a greater viewing angle when the boat 10 is in trim and the bow 14 may be blocking the view through the front windows 34. While numerous engines and propulsion systems can be employed, a high horsepower diesel engine and water-jet propulsion system are preferred because of their reliability. In that the boat 10 is designed for operation even during high sea-stages, the cockpit 12 has windows that are sealable in a watertight fashion and the boat 10 is additionally provided with a specialized air intake system (generally designated as 17) which provides air to both the cockpit 12 and the engine while filtering out water.

In general, the boat 10 is constructed from two hull sections, a lower hull section 18 and a upper hull section 20. The lower and upper hull sections 18 and 20 are formed so as to connect at what is commonly known as the chine 22. During low speed operation, with empty ballast compartments 46 as further described below, the waterline will be approximately at the chine 22.

The lower hull section 18 is generally V-shaped in cross-section and extends the length of the boat 10 until terminating in a generally vertical surface in the stern region 16. While, the lower hull section 18 is shown in a V-shape, other lower hull shapes could be employed including a U-shape, a cathedral shape, a tri-hull shape, and a catamaran or W-shape. A cut out section 24 may be provided at the stern 16 of the lower hull 18 from which a propulsion unit 26 would extend. The lower hull section 18 is further provided with a number of spaced apart and generally horizontal interruptions 28. The interruptions 28 increase the hydrodynamic lift acting on the boat 10 during the planing operational mode and also during periods of transition while getting on plane.

The upper hull section 20 exhibits a generally inverted V-shaped and also extends the length of the boat 10. A stern deck 40, a bow deck 42 and the cockpit 12 are all formed in the upper hull section 20 and these upper surfaces generally exhibit an inclination toward a vertical plane through the longitudinal centerline 31 of the boat 10.

Most of the operational controls for the boat 10, including the directional controls, navigational controls and engine controls, are contained within the cockpit 12 to provide for easy access by the operator. The cockpit 12 is generally formed by a plurality of walls and windows which are more fully described below. When riding in the cockpit 12, an operator is provided with a view in virtually all directions. In the forward direction, sight is provided through either the forward windows 34 or the roof windows 36, when in a raised position. As with the other upper surfaces, the forward windows 34 are oriented so as to be angled toward the longitudinal center of the boat 10. The forward windows 34 are also oriented, as seen in FIG. 1, to exhibit a forward point 35 in the bow 14 of the boat 10. In this manner, the forward windows 34 form a wedge-shape which directs water to the port and starboard sides of the boat 10 when the sea conditions are poor and "green" water reaches the bow 14. Integrally formed with the upper hull section 20 are sidewalls 30 and side windows 32. Both the sidewalls 30 and side windows 32 are formed to exhibit the same inclination as the upper hull section 20. The cockpit roof 38 may be generally horizontal to better accommodate the roof windows 36. The roof windows 36 are of a "flip-up" style and permit the sealing of the cockpit 12 during bad weather. The boat 10 is additionally provided with an inclined rear wall 37 and inclined rear windows 39. Vents, for the air intake system 17 previously mentioned, are also provided in the rear wall 37.

In the stern 16 of the boat 10 the upper hull section 20 is interrupted by the stern deck 40. The stern deck 40 exhibits a smaller inclination towards the longitudinal centerline 31 than the sidewalls 30 of the cockpit 12. This inclination prevents the accumulation of water on the stern deck 40 and also causes water to be readily expelled to the port and starboard sides of the boat 10.

In a manner similar to the stern deck 40, the upper hull section 20 is interrupted in the bow 14 by the bow deck 42. As previously mentioned, the bow deck 42 is inclined toward the longitudinal center line 31 of the boat 10. In conjunction with the bow deck 42, each side of the upper and lower hull sections 18 and 20 converge in the bow region 14 to give the boat 10 a distinctive wedge-shaped bow. In particular, the upper hull section 18 exhibits a leading edge 43 which immediately begins to impart an outward movement to water contacting the bow 14, during movement of the boat 10 in the low operational mode or the impact of water on the bow when in poor sea conditions. As so far described, it can be seen that the boat 10 is designed to eliminate and avoid all downward pressure exerted by water upon any of the upper surfaces, including the decks 40 and 42.

Figure 2:
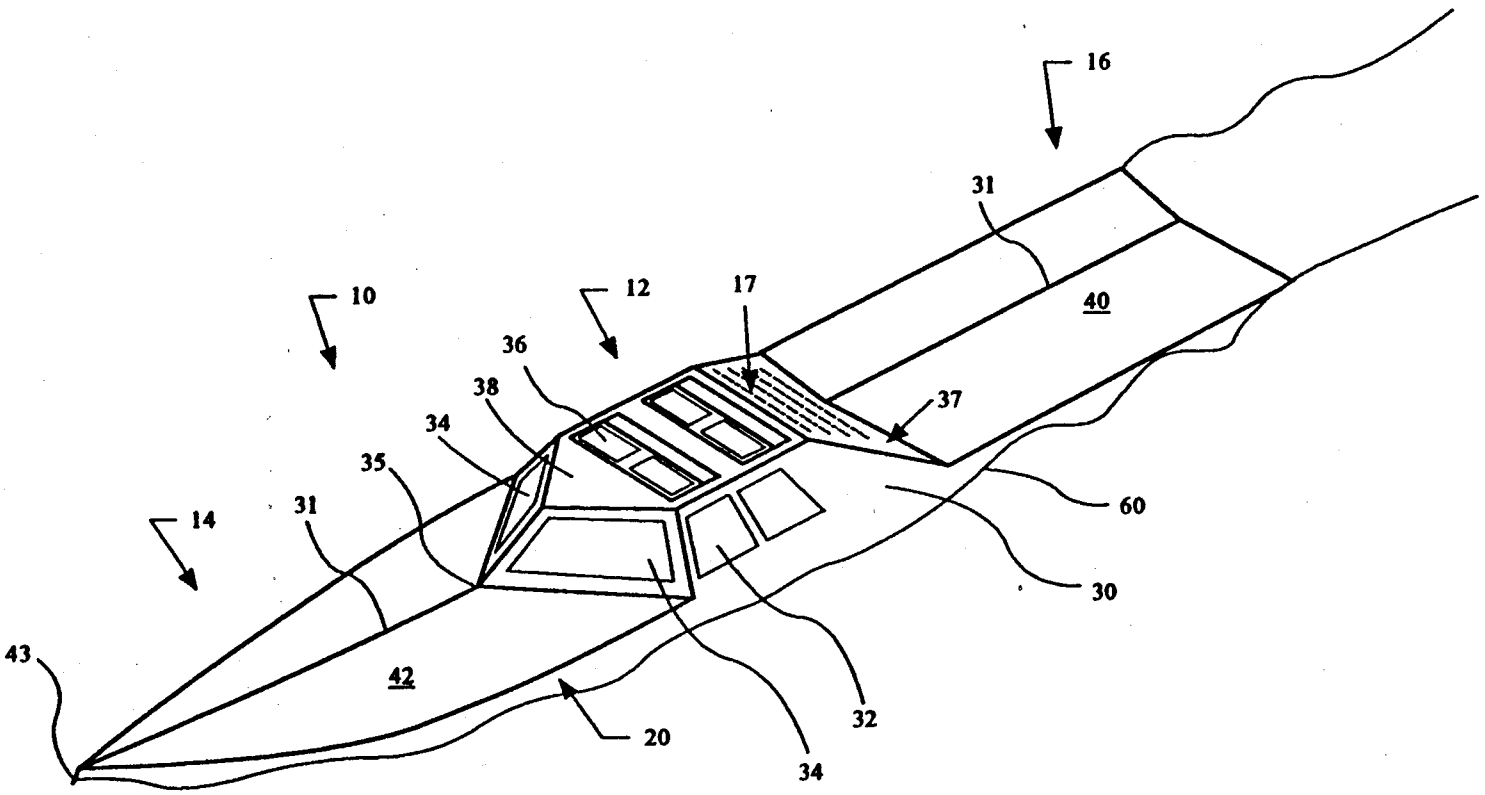
FIG. 2 is a perspective view of a boat incorporating the principles of the present invention and operating in a semi-submerged mode.
Figure 3:
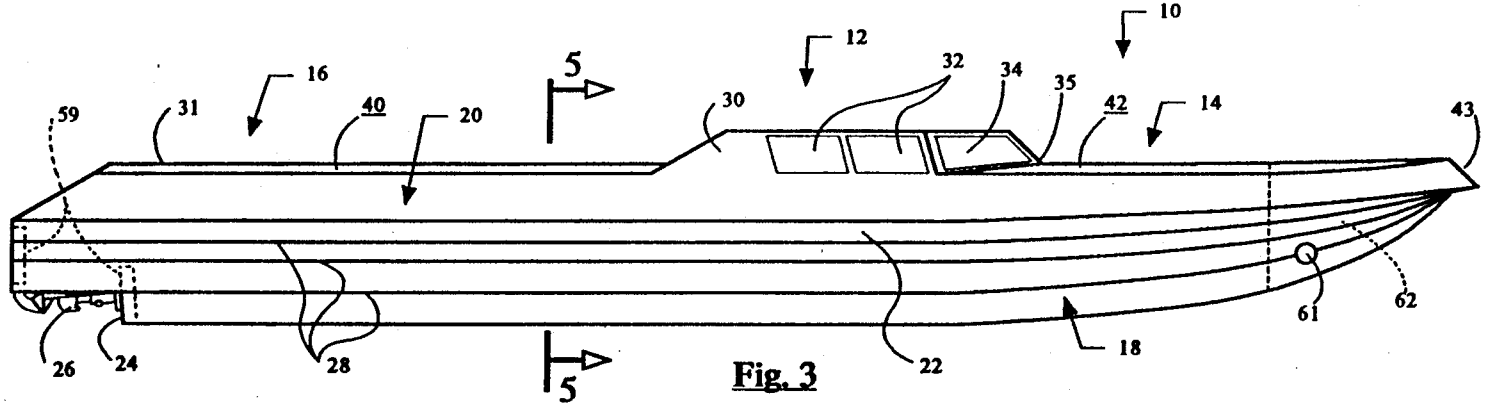
FIG. 3 is a side elevational view of the present invention.
Figure 4:
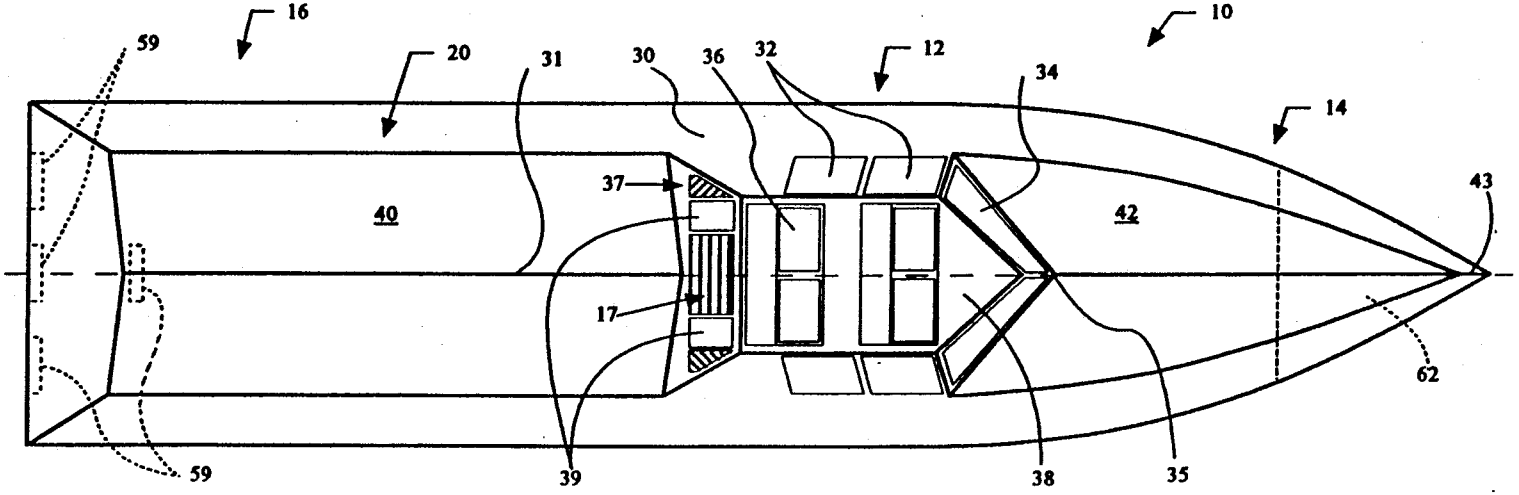
FIG. 4 is a plan view of the present invention.

In order to achieve the low operational mode illustrated in FIG. 2, the boat 10 is provided with an internal barge structure 44. The internal barge 44 extends approximately the length of the boat 10 and is spaced apart from the upper and lower hull sections 18 and 20 to define a plurality of ballast compartments, generally indicated at 46. The internal barge structure 44 can generally be of any arbitrary shape which will be contained within the cavity of hull sections 18 and 20, so long as ballast compartments 46 sufficient to partially submerge the boat 10 are provided. The internal barge 44 is of a water-tight construction and may therefore house most of the boat's systems and machinery. Such dry areas might include payload compartments (both stern and bow), the engine room, air-filtration room, and the interior of the cockpit.

The internal barge 44 of the present embodiment is itself a generally three walled structure having the various upper surfaces of the boat 10 forming a fourth or top wall. Two opposing side walls 48 extend substantially the length of the boat 10 and are connected together by a bottom wall 50 and two end walls (not shown). In this manner, the internal barge 44 and the upper and lower hull sections 20 and 18 define a number of ballast compartments 46 including a port ballast compartment 52, a lower ballast compartment 54, a starboard ballast compartment 56 and a bow ballast compartment 62. These ballast compartments may be further divided by transverse bulkheads. The port, lower and starboard ballast compartments 52, 54 and 56 communicate with one another through transverse openings formed in two bulkheads 58 which extend longitudinally beneath the opposing side walls 48 of the barge 44. The restrictions of the openings dampen the flow of water between the compartments 46 during high seastages and decreased the amount of stability which would be lost if the compartments were allowed to freely communicate. Alternatively, the compartments 46 may not communicate with one another, may communicate through other types of dampers or may communicate without any dampers at all. However, the absence of dampers would reduce the boat's 10 overall stability. In a similar manner, transverse bulkheads may be incorporated and communicate to increase longitudinal stability.

The bulkheads 58 also operates to secure the internal barge 44 to the lower hull section 18. Various conventionally known means may be employed for this securement.

As previously stated, to achieve the semi-submerged or low operational position, the ballast compartments 46 must be flooded with water. For this reason, the boat 10 is provided with means which will introduce water to these compartments 46. Such means could be active and employ power driven pumps. Alternatively, the means could be passive. One example of a passive flooding means would be a series of mechanical valves 59 formed in the stern 16 of the lower hull section 18.

When operating the boat 10 at low speeds, the valves 59 can be opened to allow water to passively flow into the ballast compartments 46. Once the ballast compartments 46 are flooded, the valves 59 are closed and the boat 10 will float upon the internal barge 44. Another example of passive flooding means would be to substitute simple openings 59 for the valves 59. In this case the boat 10 would normally be semi-submerged. Water would be drained from the ballast compartments 46 through the openings 59 as the boat 10 increased in speed. With the port 52, starboard 56 and lower 54 ballast compartments flooded during the low operational mode, the water line 60 will extend along the upper hull section 20 adjacent to the level of the stern and bow decks 40 and 42, leaving only the cockpit 12 significantly above water.

At least one distinct ballast compartment may be provided in the bow 14, and if desired, additionally in the stern 16. In the present embodiment a bow ballast compartment 62 is provided and defined in the bow 14 of the boat 10 by the forward end wall of the internal barge 44 and the upper and lower hull sections 18 and 20. The bow ballast compartment 62 may be provided as a wholly separate ballast compartment 46. When provided as an individual compartment 46, the bow ballast compartment 62 will further aid in increasing the high sea-stage stability of the boat 10. By flooding the bow ballast compartment 62 (or those in the stern 16 if provided), through separately provided ballast pumps 61, the center of gravity of the boat 10 can be shifted longitudinally. Depending on the sea conditions and the operating mode of the boat 10, the amount of ballast added to the bow compartment 62 can be varied. For example, ballast may be added in the bow compartment 62 to minimize the vertical acceleration experienced by a fast planing boat 10 in waves. Ballast may also be added to the bow ballast compartment 62 to change the trim of the semi-submerged boat 10 thereby improving riding and giving the boat 10 better longitudinal stability. The ballast pumps 61 may also be used as bow thrusters thereby increasing the boat's maneuverability in water where pivoting might prove to be necessary.

As previously mentioned, the internal barge 44 may be provided with dry payload compartments. To further allow the boat to reach a maximum semi-submerged depth, one or more of the payload compartments may be of a semi-dry nature and provided with its own flooding/evacuation means to allow for use of the payload compartment as a part-time ballast tank.

The low operational mode described above permits the boat 10 to be safely operated in varying sea-stages. Tests have indicated that the boat 10 can safely operate in this mode at speeds of seven to ten knots with sea-stages as high as SS-3. Stability of the boat 10 during the low operational mode can be partially attributed to a reduction in the boats height above the water. As previously mentioned, when in the low operational mode, the waterline 60 extends along the upper hull section 20 adjacent to the deck surfaces 40 and 42. In a preferred embodiment, the approximate height of the boat 10 above the waterline 60 during the low operational mode would be reduced to approximately 0.4 meters. In this manner, the side projection of the boat 10, depending upon its length, may be reduced by as much as 500%. The low profile permits the boat 10 to ride up and over waves and swells without experiencing dramatic rolling and pitching effects.

The inclined upper surfaces, those above the chine 22 as mentioned earlier, assist in reducing both pitching and rolling. Each upper surface of the boat 10 exhibits an incline toward the centerline 31 of forty-five degree (45°) or less, when measured up from horizontal. Without any generally vertical surfaces, wave forces are directed upwardly on impact and therefore strike only a "glancing blow" to the boat 10. In this manner the wave forces cannot induce a generally horizontal compartment, those which cause rolling and pitching, into the motion of the boat 10. Additionally, the wedge-shape of the bow 14, the shape of the front of the cockpit 12 and the inclination of the upper surfaces cause water to readily flow off of the upper surfaces thereby significantly reducing any downward pressures.

As previously stated, with the ballast compartments 46 flooded, the boat 10 can be operated in the semi-submerged mode up to speeds of approximately 7 to 10 knots. Operation above these speeds may gradually force the boat 10 up on plane. When planing, the waterline 64 is below the chine 22 along the lower hull section 18 and the boat 10 rides upon its outer skin, the lower hull 18. The valves 59 previously mentioned can then be opened allowing water to passively drain from the ballast compartments 46.

To compensate for the consumption of fuel and maintain itself in the low operational mode, the boat 10 can also be provided with collapsible fuel bags 66 positioned in the ballast compartments 46. As fuel is consumed, an increased amount of ballast water can be added to maintain the boat 10 in its low operational mode.

While the above description constitutes the preferred embodiments of the present invention, it will be appreciated that the invention is susceptible to modification, variation and change, and that the unique features increasing the all-weather performance of the invention may be found useful in other regards, without departing from the proper scope and fair meaning of the accompanying claims.

I claim:

1. A semi-submersible boat capable of exhibiting a high degree of stability and maneuverability in both calm and heavy seas, said boat comprising:

an exterior hull having a longitudinal centerline and including an upper hull portion connected to a lower hull portion and having interior surfaces defining a cavity, said upper hull portion including surfaces being inwardly inclined toward said centerline;

a barge structure formed in said cavity and extending longitudinally, said barge structure having walls being spaced apart from said interior surfaces of said exterior hull to define at least one ballast compartment therebetween;

means for filling said ballast compartment with water substantially submerging said exterior hull and said boat, the displacement of said barge structure substantially providing the flotation for said boat when said ballast compartment is filled with water;

means for removing water from said ballast compartment to thereby permit full operation and floatation of said boat on said exterior hull; and at least one separate and distinct ballast chamber formed in the bow area of said boat and including individual means for filling and removing water therefrom.

2. A boat as set forth in claim 1 wherein said ballast compartment is positioned about said centerline defining a port ballast compartment and a starboard ballast compartment.

3. A boat as set forth in claim 2 wherein said starboard ballast compartment is in communication with said port ballast compartment.

4. A boat as set forth in claim 1 wherein said upper hull portion also includes flat surfaces inclined toward said centerline.

5. A boat as set forth in claim 1 wherein said upper hull portion includes upper surfaces being inwardly inclined toward said centerline at an angle of less than ninety degrees (90°), as measured from a horizontal plane.

6. A boat as set forth in claim 1 wherein said filling means is active.

7. A boat as set forth in claim 1 wherein said removing means is active and includes means for pumping water from said ballast compartment.

8. A boat including a bow region, a stern region, a steering means, a propulsion means and exhibiting stability in a variety of water conditions, said boat comprising:

a hull having a longitudinal centerline generally defined therealong and including a lower hull portion and an upper hull portion, said upper hull portion being positioned above said lower hull portion and intersecting therewith at a chine, said upper hull portion having a generally inverted V-shaped cross section and further including upper side surfaces being inwardly inclined toward said centerline, said upper side surfaces being interrupted in the bow region by a bow deck also being inwardly inclined toward said centerline and being interrupted in the stern region by a stern deck, said upper hull portion further being interrupted between the bow and stern decks by a cockpit extending thereabove, said cockpit having sidewalls generally corresponding with said upper side surfaces of said upper hull portion, said upper side surfaces converging in the bow to form a leading edge and exhibiting a wedge-shaped forward end of said upper hull portion, said wedge shaped forward end causing water to be moved to the port and starboard sides of said boat as said boat moves through the water thereby avoiding the downward pressure of water on said upper hull portion in the bow, said lower hull and said upper hull further coacting to form a shell having an internal cavity;

a barge structure having a sealed and water-tight portion, said barge structure being positioned in said cavity and extending longitudinally therein, said sealed and water-tight portion including walls spaced apart from said lower and upper hull portions forming a plurality of ballast chambers therebetween, said plurality of ballast chambers including at least one distinct ballast chamber not in communication with another of said plurality of ballast chambers, said distinct ballast chamber having individual means for varying the amount of water contained therein and shifting the center of gravity of said boat to thereby improve the stability of said boat in waves, said barge structure further including means for securing said walls to said lower and upper hull portions; and means for flooding and evacuating said plurality of ballast chambers other than said distinct ballast chamber with water, said flooding means filling said plurality of ballast chambers other than said distinct ballast chamber with water and causing said boat to semi-submerge in the water, when semi-submerged said boat having all of said lower hull portion and a portion of said upper hull portion being submerged, said evacuation means removing water from said plurality of ballast chambers other than said distinct ballast chamber and floating said boat primarily on the displacement of said lower hull portion.

9. A boat as set forth in claim 8 wherein said upper hull portion, said cockpit sidewalls and said bow deck are inwardly inclined at an angle between zero degrees (0°) and less than ninety (90°) out from horizontal to enable said boat to counter water conditions 360° therearound which would induce destabilizing forces.

10. A boat as set forth in claim 8 wherein said means for flooding and evacuating said ballast compartments with water includes portions defining openings formed in said boat, said openings allowing for the passive flooding of water into said ballast compartments during low speed travel of said boat, said opening also allowing for the passive evacuation of water from said ballast compartments during travel at increased speeds in said boat.

11. A boat as set forth in claim 8 wherein said plurality of ballast chambers other than said distinct ballast chamber include bulkheads having portions allowing said plurality of ballast chambers other than said distinct ballast chamber to communicate therethrough thereby dampening the travel of water between said plurality of ballast chambers other than said distinct ballast chamber.

12. A semi-submersible boat capable of exhibiting a high degree of stability and maneuverability in both calm and heavy seas, said boat comprising:

an exterior hull having a longitudinal centerline and including an upper hull portion connected to a lower hull portion and having interior surfaces defining a cavity, said upper hull portion including surfaces being inwardly inclined toward said centerline;

a barge structure formed in said cavity and extending longitudinally, said barge structure having walls being spaced apart from said interior surfaces of said exterior hull to define at least one ballast compartment therebetween, said at least one ballast compartment including at least one collapsible fuel storage container positioned therein, whereby as fuel is consumed from said at least one fuel storage container as said boat is operated, the volume of water within said at least one ballast compartment may be increased so that the freeboard of said boat remains substantially unchanged;

means for filling said at least one ballast compartment with water substantially submerging said exterior hull and said boat, the displacement of said barge structure substantially providing the floatation for said boat when said ballast compartment is filled with water; and means for removing water from said ballast compartment to thereby permit operation and floatation of said boat on said exterior hull.

13. A boat which can operate in a fully buoyant mode or in a semi-submersible mode, said boat comprising:

(a) an outer hull, said outer hull defining an internal cavity;

(b) an internal hull disposed within said cavity, the space between said outer and internal hulls defining at least one ballast compartment;

(c) means for at least partially filling said ballast compartment with water to initiate the semi-submersible mode of operation of said boat, whereby when said boat is in its fully buoyant mode the hydrostatic lifting force acting upon said boat is substantially produced by the displacement of said outer hull, and whereby, when said boat is in its semi-submersible mode, the hydrostatic lifting force acting upon said boat is substantially produced by the displacement of said internal hull; and (d) at least one collapsible fuel storage container; said at least one container being positioned within said ballast compartment, whereby when said boat is in its semi-submerged mode, ballast water substantially surrounds said at least one container and whereby, as fuel is consumed while said boat is operated in the semi-submersible mode, water can replace at least part of the volume of expended fuel within said ballast compartment so that the freeboard of said boat is substantially unchanged.

14. A semi-submersible boat capable of exhibiting a high degree of stability and maneuverability in both calm and heavy seas, said boat comprising:

an exterior hull having a longitudinal centerline and including an upper hull portion connected to a lower hull portion and having interior surfaces defining a cavity, said upper hull portion including surfaces being inwardly inclined toward said centerline;

a barge structure formed in said cavity and extending longitudinally, said barge structure having walls being spaced apart from said interior surfaces of said exterior hull to define at least one ballast compartment therebetween;

means for passively filling said ballast compartment with water substantially submerging said exterior hull and said boat, the displacement of said barge structure substantially providing the floatation for said boat when said ballast compartment is filled with water; and means for removing water from said ballast compartment to thereby permit full operation and floatation of said boat on said exterior hull, said removing means being passive and associated with speed of said boat.

* * * * *